US009655382B2

(12) United States Patent
Zade et al.

(10) Patent No.: US 9,655,382 B2
(45) Date of Patent: May 23, 2017

(54) RESPONSIBLE CIGARETTE HOLDER

(71) Applicant: John R. Zade, Briarcliff, NY (US)

(72) Inventors: John R. Zade, Briarcliff, NY (US); Mariam Zade, Briarcliff, NY (US)

( * ) Notice: Subject to any disclaimer, the term of this patent is extended or adjusted under 35 U.S.C. 154(b) by 470 days.

(21) Appl. No.: 14/487,771

(22) Filed: Sep. 16, 2014

(65) Prior Publication Data

US 2016/0073688 A1 Mar. 17, 2016

(51) Int. Cl.

| | |
|---|---|
| ***A24F 13/06*** | (2006.01) |
| ***A24F 7/04*** | (2006.01) |
| ***A24F 47/00*** | (2006.01) |
| ***A24F 13/22*** | (2006.01) |
| ***A24D 3/04*** | (2006.01) |

(52) U.S. Cl.

CPC ..... *A24F 13/06* (2013.01); *A24D 3/04* (2013.01); *A24F 7/04* (2013.01); *A24F 13/22* (2013.01); *A24F 47/00* (2013.01)

(58) Field of Classification Search

CPC . A24F 13/06; A24F 7/04; A24F 47/00; A24D 1/045; A24D 3/04; A24D 3/041

USPC ..... 131/187, 201, 202

See application file for complete search history.

(56) References Cited

U.S. PATENT DOCUMENTS

| | | | | |
|---|---|---|---|---|
| 732,252 A | | 11/1902 | Assman | |
| 761,447 A | * | 5/1904 | Cassidy | A24F 1/00 131/201 |
| 2,796,869 A | * | 6/1957 | Gerard | A24F 13/06 131/182 |
| 2,998,819 A | | 6/1958 | Snowden, Jr. | |
| 3,038,477 A | | 7/1958 | Saffir | |
| 3,062,220 A | | 4/1959 | Brothers | |
| 3,006,346 A | * | 10/1961 | Golding | A24D 3/04 131/187 |
| 3,081,777 A | | 3/1963 | Sipos | |
| 3,150,668 A | | 9/1964 | Lassiter et al. | |
| 3,174,487 A | * | 3/1965 | Missler | A24F 13/04 131/187 |
| 3,194,246 A | * | 7/1965 | Mantchev | A24F 13/06 131/187 |

(Continued)

FOREIGN PATENT DOCUMENTS

| | | | | |
|---|---|---|---|---|
| FR | 1290954 A | * | 4/1962 | A24F 13/06 |
| GB | 890186 A | * | 2/1962 | A24F 13/06 |

(Continued)

OTHER PUBLICATIONS

Machine language translation of FR 1290954 obtained Feb. 8, 2017.*

*Primary Examiner* — Ruth Ilan

(57) ABSTRACT

A cigarette holder has an elongate tubular member, and includes a mouthpiece at a proximate end and a cylindrical receptacle at a distal end that is dimensioned to receive one end of a cigarette. A plurality of filters are axially spaced from each other along an intermediate portion of the holder to form air spaces between adjacent filters. Adjustable discs or rings are provided on the tubular member and are movable relative to a reference marking, one disc bearing time periods or intervals and the other disc bearing a maximum number of cigarettes that can be smoked in one time period, The discs or rings can provide cigarette reduction reminders each time period of the target number of cigarettes that can be smoked in each time period or interval.

19 Claims, 2 Drawing Sheets

(56) References Cited

U.S. PATENT DOCUMENTS

| | | | | | |
|---|---|---|---|---|---|
| 3,292,635 | A | | 12/1966 | Kolodny | |
| 3,335,733 | A | | 8/1967 | Brooks | |
| 3,395,713 | A | | 8/1968 | Ent-Keller | |
| 4,160,318 | A | * | 7/1979 | Morel | A24F 13/24 131/248 |
| 4,275,745 | A | * | 6/1981 | Carosone | A24F 13/02 131/187 |
| 4,319,587 | A | * | 3/1982 | Moser | A24D 1/12 131/270 |
| 4,343,320 | A | | 8/1982 | Muto | |
| 4,481,955 | A | * | 11/1984 | Terasaki | A24F 13/06 131/198.1 |
| 4,564,030 | A | * | 1/1986 | Jessup | A24D 3/043 131/336 |
| 5,394,894 | A | * | 3/1995 | Zade | A24F 47/00 131/270 |
| 2002/0148478 | A1 | * | 10/2002 | Pera | A24D 3/16 131/341 |
| 2004/0182401 | A1 | * | 9/2004 | Atobe | A24D 3/0287 131/202 |
| 2005/0166931 | A1 | * | 8/2005 | Hcu | A24F 13/06 131/187 |

FOREIGN PATENT DOCUMENTS

| | | | | | |
|---|---|---|---|---|---|
| GB | 1245518 | A | * | 9/1971 | A24F 13/06 |
| GB | 2394394 | A | * | 4/2004 | A24D 3/04 |

* cited by examiner

RESPONSIBLE CIGARETTE HOLDER

BACKGROUND OF THE INVENTION

1. Field of the Invention

The invention generally relates to cigarette holders and, more specifically, to a responsible cigarette holder designed to reduce the harmful effects of smoking and wean heavy habitual smokers from smoking.

2. Description of the Prior Art

Cigarettes contain hundreds of ingredients or chemical compounds. Burning these ingredients into cigarette smoke changes the ingredients into thousands of chemical by-products, at least 43 of which are known to cause cancer and exhibit other poisonous or toxic effects on human tissues. Thus, for example, ingredients in cigarette smoke are known to have adverse medical effects on the following conditions:

1. Cancer
2. Cardiovascular disease
3. Emphysema
4. Chronic lungs disease
5. Early onset wrinkles around the eyes
6. Impotence
7. Infertility
8. Yellowing of teeth
9. Dark points on gums
10. Eye cataracts and many more The U.S. Surgeon General has indicated that stopping or reducing cigarette smoking is the key to many of these cigarette-related problems. While monumental campaigns have been used to stop or prevent smoking, particularly with the younger population, cigarette smoking continues to be a health hazard and the Center for Disease Control (CDC) estimates that some 44 million people smoke in the United States.

Every year tobacco kills more Americans than were killed in WWII. Tobacco kills more than the AIDS virus, cocaine, heroin, alcohol, vehicular accidents, homicide and suicide combined. Everyday 1,200 Americans die from smoking and each of those people is replaced by two young smokers.

In addition to the public and private anti-cigarette campaigns, many devices have been proposed to help smokers reduce the harmful effects of smoking. One of the earlier developments was to incorporate cigarette filters into cigarettes through which the smoke passes before it is inhaled. Cigarette filters are helpful in reducing some of the hazardous particles from passing from the cigarette into the mouth, throat and lungs of the smoker. Thus, for example, a heat reducing cigarette filter is disclosed in U.S. Pat. No. 2,998,819, and cigarette filters are disclosed in U.S. Pat. No. 3,038,477; U.S. Pat. No. 3,081,777 and U.S. Pat. No. 3,150,668. More elaborate cigarette filters are disclosed in U.S. Pat. Nos. 3,335,733; 3,395,713 and 4,343,320. The objective of most of these filters is to block and trap smoke particles as smoke is drawn through the cigarette and the filter into the mouth.

Cigarette holders have also been proposed for helping smokers avoid the hazardous effects of cigarette smoke, including the deleterious effects of tar and nicotine. Such cigarette holders are designed to be used with cigarettes that both have filters and those that do not, providing an added measure of protection to the smokers irrespective of which cigarettes they smoke or how effective the filter is incorporated in those cigarettes. For example, a cigar pipe is disclosed in U.S. Pat. No. 732,252 that includes an absorbent material for collecting nicotine, being replaceable for use multiple times. The patent discusses the absorbent properties of the absorbent material and the cooling qualities thereof and, the ease with which the device may be cleaned. One of the embodiments discloses a diaphragm provided with a series of discs of cork, baked earth, rubber sponge or other suitable material arranged between the diaphragm and the mouthpiece. The discs are provided with minute apertures for the passage of smoke and primarily designed to remove nicotine from the smoke.

In U.S. Pat. No. 3,062,220 a plug is disclosed for removing deleterious products of combustion from tobacco smoke, a plurality of transfer wall sections being provided between the cigarette and the mouthpiece that serve as baffles for the smoke to provide a cooling effect upon the smoke with condensing action of condensable materials in the smoke. The goal is to remove material from the chamber, due to the condensation to free the smoke from harmful particles as it passes through the device. The device is described as utilizing fluid dynamics, as opposed to filtering materials, to remove the deleterious products.

In U.S. Pat. No. 3,292,635 an integral cigarette-holder is disclosed designed to provide both cooling and filtering of cigarette smoke before it reaches the mouth of the smoker. The patent discloses baffles between the inner end of the cigarette and mouthpiece that includes adjacent disc-shaped members having diametrically opposed portions of their peripheral edges that are interconnected. In storage, the discs can be collapsed into small compact space while in use they extend to the length of the space formed between the inner end of the cigarette and the mouth zone of the holder exposing a large surface area to the smoke which is required to travel a circuitous path to provide cooling of the smoke before it reaches the mouth of the user. The baffle discs are coated with an absorbent material to filter undesirable tars and other impurities out of the smoke. The baffle discs are also described as capable of being made of compressible cellulose or synthetic foams that may be impregnated with suitable adsorbents.

In view of the above, attempts to filter smoke of hazardous materials and/or cooling the smoke before it is inhaled are known. However, further improvements can and need to be made to even further reduce the deleterious effects of cigarette smoke and, at the same time, promote the reduction in the number of cigarettes that heavy smokers consume on a daily basis.

SUMMARY OF THE INVENTION

In view of the foregoing, it is an object of the present invention to provide a cigarette holder that eliminates the disadvantages of prior devices and provides improvements to prior or known cigarette holders.

It is still another object of the invention to provide a responsible cigarette holder that can be used by smokers who wish to minimize the harmful effects of cigarette smoke and, at the same time, have a goal in reducing the number of cigarettes that are smoked on a daily basis;

It is yet another object of the invention to provide a cigarette holder as suggested above that provides cooling and filtering of the smoke while helping achieve smokers a goal of reducing the number of cigarettes smoked on a daily basis.

In order to achieve the above objects, and others that will become evident hereinafter, a cigarette holder in accordance with the present invention comprises an elongated tubular member defining an axis and having proximate and remote ends and an intermediate portion between said ends. A mouthpiece is provided at said proximate end and a cylindrical receptacle is provided at said remote end dimensioned to receive one end of the cigarette in press-fit relationship to retain the cigarette and the holder when inserted therein. A plurality of disc-shaped filters are spaced from each other along said intermediate portion to form inner air spaces between adjacent filters. Said filters and said air spaces preferably have substantially equal dimensions along said axis.

In accordance with another feature of the invention, adjustable discs or rings are provided externally of said tubular member movable relative to a reference marking on the tubular member, one disc or ring bearing successive time periods or intervals, and another disc bearing the maximum number of cigarettes that can be smoked in any given time period or interval and decrimentally reduces the number of cigarettes that can be smoked in a specified time period or interval. The maximum number of cigarettes indicator is movable to a time period or interval when the cigarette holder is first used. In this way, the discs or rings can provide cigarette reduction reminders each successive time period or interval of target numbers of cigarettes that can be smoked in any one specified time period or interval.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
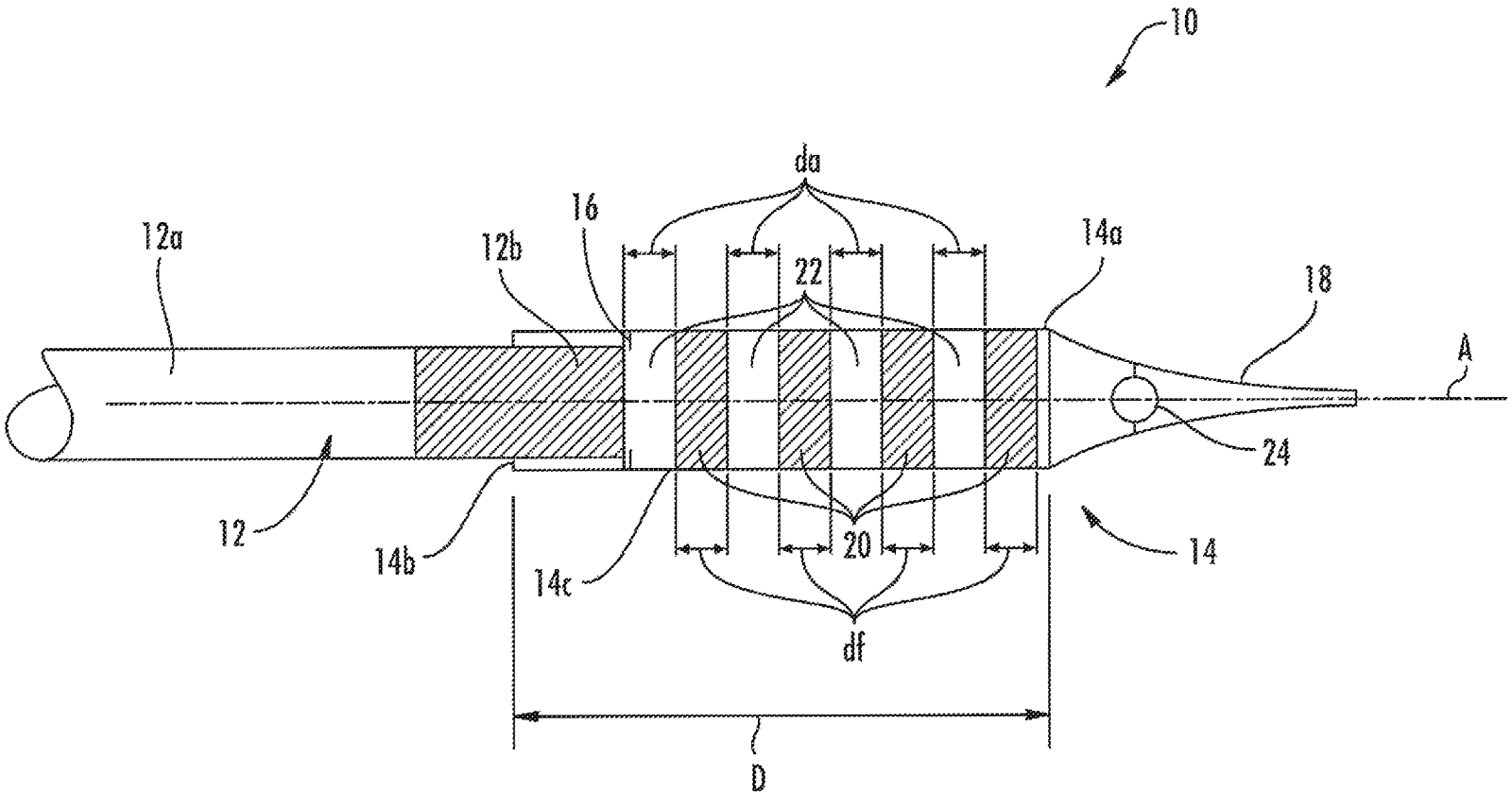
FIG. 1 is a diagrammatic side elevational view of a cigarette holder in accordance with the invention, with a cigarette inserted at one end and showing the internal construction of the cigarette holder.

Referring now to the Figures, in which identical or similar parts are designated by the same reference numbers throughout, first referring to FIG. 1, a cigarette holder in accordance with the present invention as generally designated by the reference numeral 10.

The cigarette holder 10 is intended to be used with a conventional cigarette 12 having a first portion 12*a* that includes paper-wrapped tobacco and an optional filter 12*b*. The cigarette holder 10 includes an elongated tubular member 14 that defines an axis A and has a proximate end 14*a* and a remote end 14*b* with an intermediate portion 14*c* between the proximate and remote ends. The proximate end 14*a* forms or is connected to a mouthpiece 18, a cylindrical receptacle being formed at the remote end 14*b* dimension to receive one end of the cigarette, such as the filter 12*b*, shown in FIG. 1, in press-fit relation to retain the cigarette on the holder when press-fit therein. An optional stop 16 may be provided at the remote end 14*b* at the upstream end of the cylindrical receptacle to prevent excessive penetration of the cigarette and/or filter into the holder intermediate portion 14*c*.

One aspect of the present invention is the provision of a plurality of filters 20 axially spaced, from each other along the axis of the intermediate portion 14*c* as shown to form air spaces gaps or chambers 22 between adjacent filters. The filters 20 and air spaces, gaps or chambers 22 have axial dimensions or thicknesses that are preferably substantially equal as cigarette smoke materials retain on Cambridge filter pad that materials ranging in size is from 0.2-0.4 micron.

In accordance a presently preferred embodiment the filters are Cambridge filters that filter particles ranging in size from 0.1-0.4 microns. When the filter dimensions $d_f$ and air space dimensions are both on the order of 0.5 cm and the dimension D of the holder may be on the order of 3.5-7.5 cm. The axial dimension of the mouthpiece 18 may be on the order of 3 cm while the cylindrical receptacle at the remote end may be on the order of 1 cm.

In accordance with the embodiment shown in FIG. 1, there is preferably provided a trap 24 within the mouthpiece 18 for trapping deleterious tobacco smoke particles or by-products within the tubular member. Any commercially available traps can be used for reducing tar and nicotine. One such trap is marketed under the brand name TAREX™, distributed in the U.S. by Briar Trading Co., Inc. of Briarcliff Manor, N.Y. Other traps are marketed under the brand name NICSTOP® and NICOUT™ marketed by Safety Aid Supplies, Inc.

Figure 2:
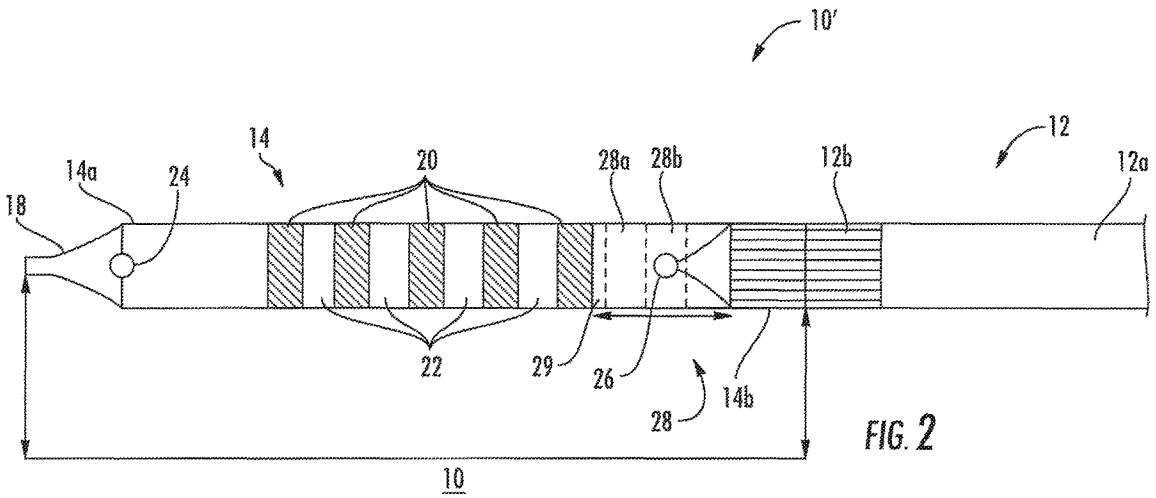
FIG. 2 is similar to FIG. 1 but illustrating a second embodiment of the invention.

The tar and/or nicotine traps can be arranged either in the mouthpiece as shown in FIG. 1 or positioned upstream of the filter proximate to the cylindrical receptacle for the cigarette, as suggested in FIG. 2.

It has been shown that nicotine from smoking cigarettes reaches the brain within 10 seconds. 80% of people that smoke become addicted to cigarettes the first time they smoke. As suggested, many of the chemical elements or by-products in cigarette smoke contain numerous carcinogens. The present invention is a cigarette holder that can be formed of any material, including silver, amber, wood or plastic. Because temperatures of cigarettes during inhalation is 70° C. (158° F.). A cigarette smoker who smokes 20 cigarettes a day intakes 450 mg of tar into their lungs. The harmful effects of cigarette smoking cannot be over emphasized. The present invention seeks to reduce the harmful effects of cigarette smoke by reducing the number of harmful particles and carcinogens and by cooling the cigarette smoke, irrespective of the construction of a cigarette or any filters that may be incorporated therein. It is known, for example, that at very high temperatures the tar in cigarette smoke becomes a soft or viscous and essentially remains in a molten state until it cools off. However, by the time that the tar cools off it sticks to the lung and other tissues. Both tar and most carcinogenic substances, including nicotine and tar, are most harmful when they are extremely hot as these not only damage the mouth, esophagus and lung tissues but these harmful substances adhere themselves and stick to the tissues to provide lingering harmful effects.

In accordance with the invention, there are successive stages for both filtering and cooling in the spaces to reduce the number of deliterious particles that can reach the mouthpiece 18. However, the cigarette smoke is also cooled at each stage to reduce the initial temperatures of the smoke as much as 50%. Thus, while the lit end of a cigarette is 800° C.-880° C. the smoke emanating from the cigarette is roughly 400° C.-500° C., the cigarette holder, in accordance with the invention can reduce the temperature of the cigarette smoke to as little 37° C. or 98° F. which is normal body temperature.

Referring to FIG. 2, a modified construction is shown in which five filters 20 are provided that form four air spaces or chambers 22. The axial dimensions or thicknesses of each of the filters and chambers may be the same as discussed in connection with FIG. 1, namely 0.5 cm each. In the embodiment of FIG. 2, two traps 24, 26 are provided as shown. The overall axial length of the holder is approximately 10 cm, with the cylindrical receptacle for the cigarette being approximately 1 cm.

Figure 4:
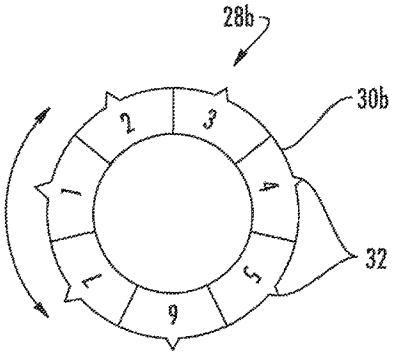
FIG. 4 is similar to FIG. 3 but bearing numbers representing the maximum number of cigarettes that a user is reminded to smoke on a daily basis to remind the user of the reduced number of cigarettes each successive day of the week of target number of cigarettes that can be smoked in any one time period or interval.
Figure 3:
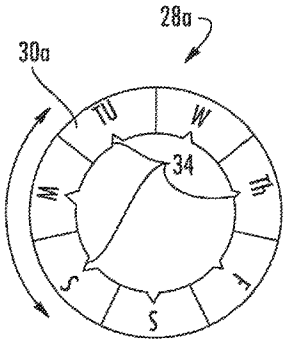
FIG. 3 is a diagrammatic view of one disc or ring on the cigarette holder as shown in FIG. 2 bearing successive days of the week.

Another aspect of the invention is to provide a simple and convenient way for a smoker to establish practical goals for reducing and, hopefully, eliminating the number of cigarettes that is smoked each day or any other predetermined time period or interval. Studies have shown that heavy smokers smoke as many as 10-20 cigarettes or more a day. Typically, such heavy smokers cannot sustain such heavy smoking without experiencing serious health problems. The body can normally "tolerate" 1, 2 or even 3 cigarettes per day although, clearly, this is also not desirable. The present invention allows a heavy smoker to set a goal to gradually reduce the number of cigarettes that are smoked every day to at least tolerable levels. Towards that end, referring to FIG. 2-4, there is provided adjustable reminder device markers 28 in the form of two adjustable discs or rings 28*a*, 28*b* that are exteriorly mounted on the tubular member 14 and are movable relative to each other and relative to a reference Marking 29 fixed on the tubular member proximate to the discs or rings. In the example illustrated the disc 28*a* shows successive days of the week 30*a*, each letter representing one day of the week, and another disc 28*b* bears the maximum number of cigarettes 30*b* that can be smoked in any one day. The second disc or ring 28*b* is provided with decrimentally reduced numbers representing the number of cigarettes that can be smoked on any one day. In the example shown, the numbers are decrimentally marked from "7", the maximum, to a minimum of "1". It should be clear, however, that these numbers can be modified and any decreasing sequence of numbers may be used. Thus, the numbers can also start with 20, for example, and be decremented by 2 or 3 number increments and the lowest number can be 0. Whatever the maximum number on the disc or ring 28*b*, it is movable to be in juxtaposition with a day of the week (or other time period or interval) on the wheel or disc 28*a* when the cigarette holder is first used to set a goal of cigarette reduction. It will be clear that the discs can provide cigarette reduction reminders each successive day of a week of target number of cigarettes that can be smoked in one day. Therefore, for example, if the first day that the device is used is on Tuesday ("Tu") the highest number (e.g. 7) on the disc or ring 28*b* is rotated to be in a juxtaposed position with that day "Tu". Once so adjusted, the discs or rings can remain fixed in place by detents, 32, 34 so that on Wednesday the number 6 appears in juxtaposed position indicating that on the second day of use only 6 cigarettes may be smoked on that day. Similarly, on Friday 5 cigarettes may be smoked on that day and so on. The numbers are shown in FIG. 4 in the reverse order, assuming that the disc or ring 28*b* is flipped 180° in juxtaposed position with the disc or ring 28*a*. If they are arranged one within the other in the same plane as shown in FIGS. 3 and 4 the numbers would need to be reversed so that, starting with the number 7, the numbers decrease in a clockwise direction as viewed in FIG. 4. The idea is that once the device is first used on a given day each subsequent day the disc or ring 28*b* alerts a user as to the maximum number of cigarettes that can be smoked on that day of the week (or other time period or interval). In this connection, the disc or ring 28*a* may also be labeled with week numbers, months or any other time indicators or intervals that may suit a given smoker. For most rapid reduction in the level of smoking days of the week, as shown, would be used.

In accordance with a modified embodiment a plurality of rings 28*b* are provided with different number sequences for use by heavier smokers. For example, two or more rings 28*b* may be provided with number sequences continuing between rings. Thus, a second ring can be numbered 8-14, a third ring can be numbered 15-21, etc. to allow heavier smokers to start at higher numbers and work their way down by replacing rings as necessary. It is also possible to increase the number of segments from 7 to any desired number. This would allow heavier smokers to start at higher cigarette numbers per day while needing fewer number of rings. Also, the increments on ring 28*b* need not be one cigarette. Thus, increments of two, three or any desired number of cigarettes can be used. Thus, for example, ring 28*b* may read, for a one cigarette pack per day smoker, "20, 17, 14, 11, 8, 5, 3, 2, 1" using nine segments on only one ring as the increments need not be the same at all positions.

The Marker or indicia 28 can be used on a cigarette holder with or without the filters 20 and inner spaces or gaps 22 while still serving as a tool for reminding users on the need to cut back on the number of cigarettes smoked each day or other time period or interval. Preferably, however, the filters 20 and air gaps 22 are used in conjunction with the reminder mechanism 28 so that the user is simultaneously provided increase protection from hazardous byproducts while cutting back on the number of cigarettes smoked and trying to eliminate the smoking habit.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed:

1. A cigarette holder comprising an elongate tubular member defining an axis and having proximate and remote ends and an intermediate portion between said ends; a mouthpiece at said proximate end; a cylindrical receptacle at said remote end dimensioned to receive one end of a cigarette in press-fit relation to retain the cigarette on the holder when press fit therein; and a plurality of filters axially spaced from each other along said intermediate portion to form aft spaces between adjacent filters, said filters and said air spaces having substantially equal dimensions along said axis; and said cigarette holder further comprising adjustable discs or rings externally to said tubular member that are movable relative to a reference marking on said tubular member, one disc or ring bearing time periods or intervals and another disc or ring bearing a maximum successive number of cigarettes that can be smoked in one of said time periods or intervals and decrimentally reducing the number of cigarettes that can be smoked in successive time periods or intervals, the maximum number of cigarettes disc or ring being movable to a time period or interval when the holder is first used, or interval of a target number of cigarettes that can be smoked in each successive time period or interval.

2. A cigarette holder as defined in claim 1, wherein at least four filters are provided.

3. A cigarette holder as defined in claim 2, wherein five filters are provided.

4. A cigarette holder as defined in claim 1, wherein each of said filters has an axial dimension of approximately 0.5 cm.

5. A cigarette holder as defined in claim 1, each of said air spaces has an axial dimension of approximately 0.5 cm.

6. A cigarette holder as defined in claim 1, wherein said mouthpiece and cylindrical receptacle for the cigarette are separated by an axial distance selected from the range of 3.5-7.5 cm.

7. A cigarette holder as defined in claim 1, further comprising at least one trap for deleterious tobacco smoke by-products passing through said tubular member.

8. A cigarette holder as defined in claim 7, wherein said at least one trap is positioned within said mouthpieces.

9. A cigarette holder as defined in claim 7, wherein said at least one trap is positioned upstream of said filters proximate to said cylindrical receptacle.

10. A cigarette holder as defined in claim 7, wherein said at least one trap comprises two traps are provided one proximate to said mouthpiece and one positioned upstream of said filters proximate to said cylindrical receptacle.

11. A cigarette holder as defined in claim 1, further comprising a detent for allowing manual relative movements between said discs while preventing inadvertent relative movements once said discs have been manually set.

12. A cigarette holder kit comprising an elongate tubular member defining an axis and having proximate and remote ends and an intermediate portion between said ends;

a mouthpiece at said proximate end;

a cylindrical receptacle at said remote end dimensioned to receive one end of a cigarette in press-fit relation to retain the cigarette on the holder when press fit therein;

a plurality of filters axially spaced from each other along said intermediate portion to form air spaces between adjacent filters, said filters and said air spaces having substantially equal dimensions along said axes; and a plurality of adjustable discs or rings marked with different indicia selectively attachable externally of said tubular member and movable relative to a reference marking on said tubular member, one disc bearing time periods or intervals and another disc selected to reflect a smoker's smoking habit and desired smoking reduction goals bearing a maximum successive number of cigarettes that can be smoked in one time period or interval and decrimentally reduced the number of cigarettes that can be smoked in one time period or interval, the maximum number of cigarettes indicator being movable to a time period or interval when the cigarette holder is first used, whereby said discs or rings can provide cigarette reduction reminders each time period or interval of a target number of cigarettes that can be smoked in one day.

13. A cigarette holder as defined in claim 12, further comprising a detent for allowing manual relative movements between said discs while preventing inadvertent relative movements once said discs have been manually set.

14. A cigarette holder as defined in claim 12, further comprising at least one trap for deleterious tobacco smoke by-products within said tubular member.

15. A cigarette holder as defined in claim 14, wherein said at least one trap is positioned within said mouthpiece.

16. A cigarette holder as defined in claim 14, wherein said at least one trap is positioned upstream of said filters proximate to said cylindrical receptacle.

17. A cigarette holder as defined in claim 14, wherein said at least one trap comprises two traps are provided one proximate to said mouthpiece and one positioned upstream of said filters proximate to said cylindrical receptacle.

18. A cigarette holder comprising an elongate tubular member defining an axis and having proximate and remote ends and an intermediate portion between said ends;

a mouthpiece at said proximate end;

a cylindrical receptacle at said remote end dimensioned to receive one end of a cigarette in press-fit relation to retain the cigarette on the holder when press fit therein; and adjustable discs or rings externally of said tubular member movable relative to a reference marking on said tubular member, one disc bearing time periods or intervals and another disc bearing a maximum successive number of cigarettes that can be smoked in one time period or interval and decrementally reduced the number of cigarettes that can be smoked in one time period or interval, the maximum number of cigarettes indicator being movable to a time period or interval when the cigarette holder is first used, whereby said discs or rings can provide cigarette reduction reminders each time period or interval of a target number of cigarettes that can be smoked in each successive time period or interval.

19. A cigarette holder as defined in claim 18, further comprising a detent for allowing manual relative movements between said discs while preventing inadvertent relative movements once said discs have been manually set.

* * * * *